US008490548B2

(12) United States Patent
Sauron

(10) Patent No.: US 8,490,548 B2
(45) Date of Patent: Jul. 23, 2013

(54) DEVICE FOR RAILWAY MAINTENANCE

(75) Inventor: Jean Sauron, Draveil (FR)

(73) Assignee: CTF France, Bondoufle (FR)

( * ) Notice: Subject to any disclaimer, the term of this patent is extended or adjusted under 35 U.S.C. 154(b) by 235 days.

(21) Appl. No.: 13/062,821

(22) PCT Filed: Sep. 4, 2009

(86) PCT No.: PCT/FR2009/051672

§ 371 (c)(1),
(2), (4) Date: Apr. 1, 2011

(87) PCT Pub. No.: WO2010/029248

PCT Pub. Date: Mar. 18, 2010

(65) Prior Publication Data

US 2011/0168050 A1 Jul. 14, 2011

(30) Foreign Application Priority Data

Sep. 9, 2008 (FR) ..... 08 56050

(51) Int. Cl.
*E01B 11/44* (2006.01)
*E01B 31/18* (2006.01)
*B61F 9/00* (2006.01)

(52) U.S. Cl.
USPC ..... 104/15; 104/242

(58) Field of Classification Search
USPC ..... 104/2, 15, 242, 243
See application file for complete search history.

(56) References Cited

U.S. PATENT DOCUMENTS 5,080,021 A * 1/1992 Thorsen ..... 105/163.2
2002/0125216 A1 9/2002 Sauron et al.

FOREIGN PATENT DOCUMENTS

CH 624351 A5 7/1981
EP 0992628 A2 4/2000
EP 1145793 A1 10/2001
RU 2253712 C1 6/2005

OTHER PUBLICATIONS

International Search Report, dated Jan. 27, 2010, from corresponding PCT application.
French Search Report, dated Apr. 14, 2009, from corresponding French application.

* cited by examiner

*Primary Examiner* — Zachary Kuhfuss
(74) *Attorney, Agent, or Firm* — Young & Thompson

(57) ABSTRACT

A device (1) for the maintenance and the repair of rails and railroad apparatuses, includes: a frame (2); elements (3, 4, 5) of displacement on a rail; the elements of displacement including two wheels (4, 5) aligned with an axis (6) of displacement of the device along a rail (7). The frame (2) is arranged on the elements (3) of displacement so that, when the wheels of the device are positioned on a rail (7), the center of gravity (22) of the device is placed vertically to the rail. According to a preferred embodiment, each wheel is provided with two flanges (12, 13) having a substantially annular shape, the position of at least one of the flanges being axially adjustable.

6 Claims, 2 Drawing Sheets

DEVICE FOR RAILWAY MAINTENANCE

Figure 1:
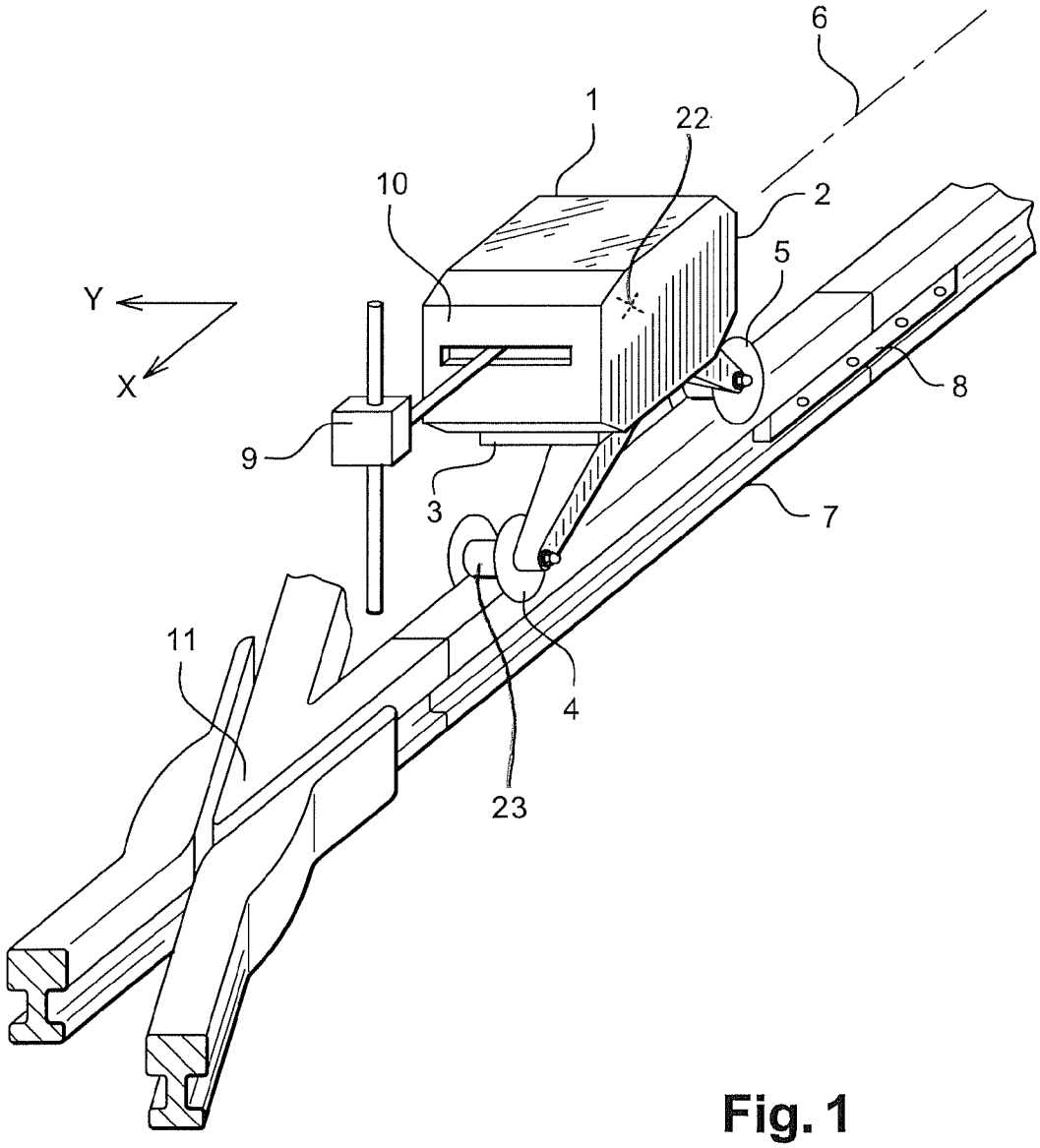

The present invention refers to the maintenance and the repair of worn rails, for example the rails of railroad networks.

More precisely, the present invention refers to a device for the repair and the maintenance of rails and railroad line apparatuses.

The circulation of vehicles such as trains induces a wear of the rails which support them. This wear is apparent for example in the form of scratches or hollows in the surface of the rails. In order to maintain the railroads in operating condition, it is advisable to fill in these scratches or these hollows.

In order to ensure the maintenance of the rails, it is in particular known to use automated machines especially designed to repair these hollows, by filling them with a welding material.

For example, the patent EP 1 145 793 describes an arc welding machine for the maintenance of the rails. This machine comprises a frame, a welding equipment including a torch for welding a rail zone, as well as a control unit.

This machine is equipped with two maintenance means on the rail to be repaired. Each one of these means can consist of a horizontal bar. An extremity of said bar ends in a tong hooking the rail. One of the jaws of the tong passes under the rail head, i.e. under the part of the rail which comes into contact with the railroad vehicles. The other extremity of the horizontal bar is fixed to the frame. Said frame is thus out of plumb relative to the rail, its weight enabling the tong to firmly remain hooked under the rail head. The torch, located on a side face of the frame, is placed vertically to the rail to be repaired.

According to the patent EP 1 145 793, the welding torch is provided with means of displacement along two axes in a horizontal plane. This mobility in two dimensions makes it possible to record the co-ordinates of at least three points, defining a rail surface to be repaired, then to let the machine carry out this repair.

However, such a device presents several disadvantages, in particular related to the tong-shaped means of maintenance. For example, two adjacent rails can be made interdependent by means of at least one alignment fishplate. Such a fishplate is in particular placed along the least thick part of the rail, under the rail head. The presence of such a fishplate does not enable the use of the tong-shaped means of maintenance, because the place of an extremity of the tong is occupied by the fishplate.

Another disadvantage is related to the maintenance of the railroad apparatuses or railroad switches. As the welding torch is located on a side face of the machine, it is appropriate to position the tongs on both sides of the zone to be repaired. However, such a positioning is sometimes made impossible by the specific shapes of the parts of the railroad apparatus, in particular the tongue of the crossing.

Devices for maintaining rails are also known, that are provided with means of displacement on said rails such as rollers. The documents CH 624351 and RU 2253712 describe in particular devices moving by means of rollers supported by two parallel rails, said rollers being divided into two groups arranged on both sides of a vertical plane passing through the centers of gravity of said devices.

By center of gravity, one understands the point of intersection of all the planes which divide the device into two parts of equal weights.

The devices described in the documents CH 624351 and RU 2253712 require, for moving, the presence of two parallel rails. It is thus difficult to use them for the maintenance of railroad switches or tongues of a crossing, i.e. in zones where the rails are arranged in a nonparallel way.

The present invention makes it possible to solve these disadvantages, by modifying the arrangement and the means of maintenance of the apparatus. The invention thus relates to a device for the maintenance or the repair of rails and railroad apparatuses, said device including in particular a frame and means of displacement on a rail, the means of displacement comprising two wheels aligned with an axis of motion of the device along a rail, said device being characterized in that the frame is arranged on the means of displacement so that, when the wheels of said device are positioned on a rail, the center of gravity of said device is placed vertically to said rail.

Contrary to the device described in the patent EP 1 145 793, a device according to the invention is not out of plumb relative to the rail to be repaired. The center of gravity of the device is placed vertically to said rail to be repaired. It enable said device to move easily by rolling on the rail, without being likely to tip over.

According to a preferred embodiment of the invention, each wheel is provided with two flanges having a substantially annular shape. More preferentially, the position of at least one of the two flanges is adjustable according to an axis of the wheel. The device can thus be moved on a rail by making it roll; then, once the appropriate position has been chosen, the mobile flange can be moved towards the fixed flange in order to tighten the rail head between the two flanges. The device is thus maintained firmly at a specific place of the rail. This system of maintenance is particularly adapted to precision works such as arc welding.

According to a preferential embodiment of the invention, an internal surface of at least one flange has substantially the shape of a truncated cone of revolution, said surface being intended to come into contact with a rail. This truncated shape enables the flange to follow the profile of a conventional rail head. More preferentially, the truncated-cone surface is tilted with an angle between 1° and 15° relative to the base of said cone. Still more preferentially, the angle is comprised between 2° and 5°.

Figure 2:
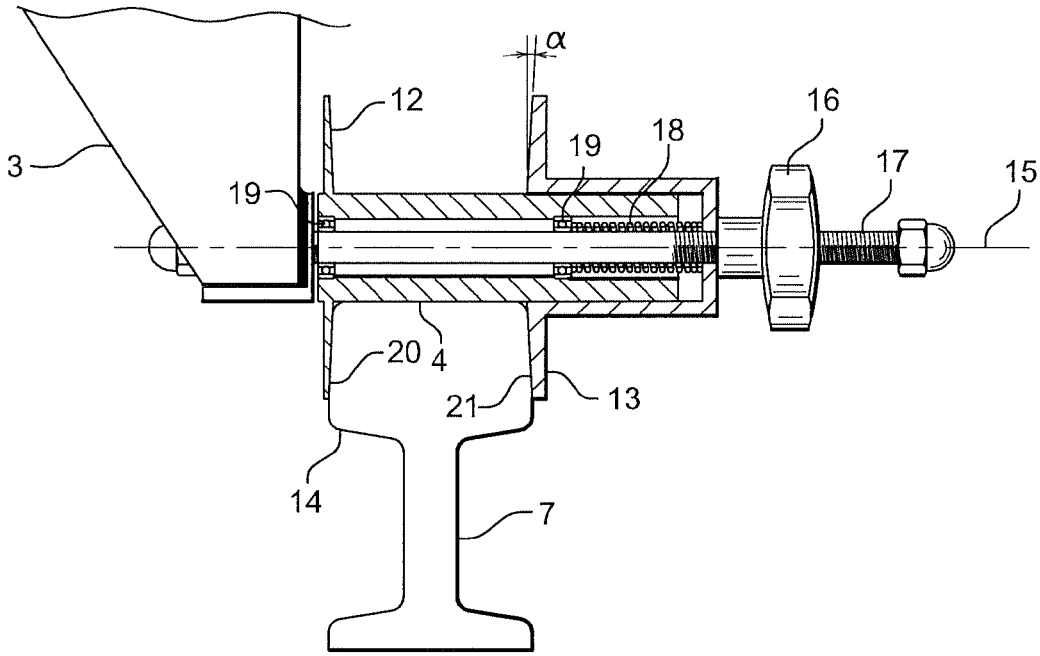

The invention will be better understood with the reading of the following description and the examination of the joined figures. Those are given as an indication and by no means as a limitation of the invention. The figures show:

FIG. 1: a perspective view of a device according to an embodiment of the invention;

FIG. 2: a sectional view of a wheel of a device as represented in FIG. 1.

FIG. 1 represents a device according to an embodiment of the invention. In this example, it is question of an arc welding device. However, the invention also relates to other devices for the maintenance of rails, for example grinding devices.

The device 1 comprises a frame 2, which is supported by a chassis 3 it is linked to. The chassis 3 is provided with two wheels (4, 5). The wheels (4, 5) are aligned with an axis of displacement 6 of the device 1 along a rail 7 to be repaired.

One of the advantages of the wheels (4, 5), compared to the system of tongs described in the patent EP 1 145 793, is that the positioning of the device 1 is not hampered by the presence of fishplates 8 at the junction of two rails.

The frame 2 is arranged on the chassis 3 so that, when the wheels (4, 5) are positioned on a rail 7, the center of gravity 22 of the device 1 is placed vertically to said rail 7.

More precisely, it is considered a vertical plane, parallel to the axis 6 and passing through the center of gravity 22 of the device 1. This vertical plane passes through a part 23 of each wheel (4, 5), said part 23 being intended to be supported by the rail 7.

In this manner, the device 1 is not likely, due to its weight, to tip over on one side of the rail 7. That is advantageous for operators likely to move the device 1 by making it roll on the rails to be repaired. It is also possible to motorize the chassis 3 for displacing it by means of the wheels (4, 5) on the rail 7.

In an advantageous way, the wheels (4, 5) are provided with a long wheelbase, i.e. a distance between the axles of said wheels (4, 5) in the direction of the axis 6 is equal to at least two thirds of a length of the frame 2 in the direction of said axis 6. This distance between the wheels makes the device 1 more stable, by limiting the risks of tilting forwards or backwards in the direction of the axis of displacement 6.

According to the embodiment of the invention represented in FIG. 1, the frame 2 is provided with a welding equipment including a torch 9. The torch 9 is equipped with means of translation along two axes (X, Y) in a horizontal plane. A torch equipped with such means is described in the patent EP 1 145 793.

According to the invention, the frame 2 is placed substantially vertically to the rail 7 to be repaired, contrary to the apparatus described in the patent EP 1 145 793. The invention thus makes it possible to place the torch 9 at an extremity 10 of the device 1, along the axis of displacement 6. It can be indifferently the front extremity or the rear extremity. Contrary to the apparatus described in the patent EP 1 145 793, the torch is thus not arranged on a side face of the apparatus.

This arrangement of the torch 9, for example in front of the frame 2, allows the maintenance of parts having a specific shape, such as tongues 11 of a crossing of the railroad apparatuses. Indeed, an apparatus with a welding torch on a side face, as described in the patent EP 1 145 793, is sometimes inappropriate to this type of part. The system of maintenance made up of two aligned tongs, on both sides of the torch, is more appropriate to a rectilinear rail than with to an element such as a tongue 11 of a crossing.

On the contrary, according to the embodiment of the invention represented in FIG. 1, it is easy to position the device 1 near the tongue 11 of a crossing. The torch 9 is placed in front of the frame 2. Said torch is thus, in its turn, easily arranged vertically to said tongue of a crossing, to maintain or repair the zone concerned.

FIG. 2 represents a sectional view of a wheel 4 of the device 1, positioned on a rail 7. The wheel 4 is provided with two flanges (12, 13) on both sides of the head 14 of the rail 7. The two flanges (12, 13) have a substantially annular shape. One of the functions of the flanges (12, 13) is to guide the device 1 during its displacement on the rail 7, therefore to avoid the derailment thereof.

In a preferential way, one of the flanges 12 is fixed, while the other flange 13 is mobile along an axis 15 of the wheel 4. This system makes it possible to block the device 1 in a precise position on the rail 7, by pressing the head 14 of said rail 7 between the flanges (12, 13) like in a vice. When one wishes to move the device 1, the flange 13 can be loosened in order to make the wheel 4 mobile again.

This system, which makes it possible to very precisely regulate the position of the device 1, is extremely advantageous for meticulous operations of rail maintenance, like arc welding. Moreover, the adaptability of the space between the flanges 12 and 13 makes it possible to use the device 1 on rails of various gauges.

One considers the vertical plane, previously mentioned, parallel to the axis 6 and passing through the center of gravity 22 of the device 1. In order to place said center of gravity 22 vertically to the rail 7, whatever the position of the mobile flange 13, it is advantageous that the flanges (12, 13) be located on both sides of said vertical plane when the flange 13 is positioned as near as possible to the flange 12. It is thus preferable to dimension and arrange the wheel 4 according to the position of the vertical plane mentioned above.

Various adjustment systems for positioning the mobile flange 13, known by the man skilled in the art, can be adopted. According to the embodiment of the invention represented in FIG. 2, the adjustment system includes a tightening button 16, a partially threaded stem 17 and a tightening spring 18. The wheel 4 is mobile around the stem 17 thanks to ball bearings 19.

The flanges (12, 13) come into contact with the rail 7 via an internal surface (20, 21). A surface of a flange is considered as internal if it is placed opposite the other flange. In a preferential way, an internal surface 20 or 21 of at least one flange 12 or 13 substantially has the shape of a truncated cone of revolution. In a more preferential way, internal surfaces (20, 21) of both flanges (12, 13) substantially have the shape of a truncated cone of revolution.

This truncated shape makes it possible to more effectively follow the lateral edges of the head 14 of a rail 7. Indeed, in a conventional way, said edges are slightly tilted relative to the vertical. More precisely, the edges of the head 14 move away from one another while going down.

In a preferential way, according to a sectional plane containing the axis 15 of the wheel 4, a surface 20 or 21 forms an angle $\alpha$ with a plane perpendicular to the axis 15. This angle is such that the surfaces (20, 21) deviate from one another as one moves away from the axis 15.

In a preferential way, the angle $\alpha$ lies between 1° and 15°, more preferentially between 2° and 5°, even more preferentially between 3° and 4°.

The truncated surfaces (20, 21) enable the flanges (12, 13) to follow the edges of a conventional rail head 14, far better than the plane surfaces. The degree of tightening of the flanges (12, 13) around the rail 7 is thus improved, which also improves the precision of the maintenance work made by the device 1.

The characteristics of the truncated shapes of the surfaces 20 and 21 are selected according to the type of rail to be repaired. In the example in FIG. 2, these surfaces are convex, i.e. the surfaces (20, 21) deviate from one another as one moves away from the axis 15. According to the shape of the head 14 of the rail to be repaired, one can also give the surfaces (20, 21) a concave shape, the surfaces (20, 21) approaching to one another as one moves away from the axis 15. It is also possible to choose an angle $\alpha$ different for the flange 12 and for the flange 13, while remaining within the scope of the invention.

The invention claimed is:

1. A device (1) for the maintenance or the repair of rails and railroads apparatuses, said device notably comprising:

a frame (2); and means (3, 4, 5) of displacement on a rail;

the means of displacement comprising two wheels (4, 5) aligned with an axis (6) of displacement of the device along a rail (7);

wherein the frame (2) is arranged on the means (3) of displacement so that, when the wheels of said device are positioned on a rail (7), the center of gravity (22) of said device is placed vertically to said rail; and wherein each wheel is provided with two flanges (12, 13) having a substantially annular shape characterized in that a position of at least one of the two flanges (13) is adjustable relative to an axis (15) of the wheel.

2. Device according to claim 1, characterized in that an internal surface (20) of at least one flange substantially has the shape of a truncated cone of revolution, said surface (20) being intended to come into contact with a rail (7).

3. The device according to claim 2, characterized in that the surface (20) having a shape of a truncated cone is tilted with an angle between 1° and 15° relative to a base of said cone.

4. The device according to claim 1, characterized in that the device is provided with arc welding means (9).

5. The device according to claim 4, characterized in that the arc welding means (9) are arranged at a front or back extremity (10) of the device, in the direction of an axis (6) of displacement along a rail.

6. A method for repairing and/or maintaining rails or railroad apparatuses, comprising a step of using a device according to claim 1.

* * * * *

UNITED STATES PATENT AND TRADEMARK OFFICE

CERTIFICATE OF CORRECTION

PATENT NO. : 8,490,548 B2
APPLICATION NO. : 13/062821
DATED : July 23, 2013
INVENTOR(S) : Jean Sauron It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 258 days.

Signed and Sealed this
Eighth Day of September, 2015

Michelle K. Lee

Michelle K. Lee
*Director of the United States Patent and Trademark Office*